US005557866A

United States Patent [19]

Prengler

[11] Patent Number: 5,557,866

[45] Date of Patent: Sep. 24, 1996

[54] ATHLETIC FOOTWEAR WITH HINGED ENTRY AND FASTENING SYSTEM

[76] Inventor: Randall Prengler, 4025 Desert Mountain Dr., Plano, Tex. 75093

[21] Appl. No.: 116,735

[22] Filed: Sep. 7, 1993

[51] Int. Cl.[6] ..... A43B 11/00; A43C 11/00

[52] U.S. Cl. ..... 36/138; 36/50.1

[58] Field of Search ..... 36/138, 105, 50.1, 36/50.5, 54

[56] References Cited

U.S. PATENT DOCUMENTS

| | | | |
|---|---|---|---|
| Re. 6,333 | 3/1875 | Ballard | 36/50.1 |
| 145,801 | 12/1873 | Hersome | 36/50.1 |
| 474,574 | 5/1892 | Bruzon | 36/138 |
| 503,588 | 8/1893 | Elterich . | |
| 4,280,286 | 7/1981 | Sartor | 36/105 |
| 4,470,205 | 9/1984 | Olivieri | 36/114 |
| 4,633,599 | 1/1987 | Morell et al. | 36/50.5 |
| 4,813,668 | 3/1989 | Solloway | 272/116 |
| 4,823,484 | 4/1989 | Couty | 36/50.5 |
| 4,893,419 | 1/1990 | Arieh et al. | 36/50.5 |
| 4,972,613 | 11/1990 | Loveder | 36/105 |
| 5,184,410 | 2/1993 | Hamilton | 36/138 |

FOREIGN PATENT DOCUMENTS

| | | | |
|---|---|---|---|
| 2516762 | 5/1983 | France | 36/50.1 |
| 0017357 | 5/1910 | United Kingdom | 36/50.1 |

*Primary Examiner*—Ted Kavanaugh

*Attorney, Agent, or Firm*—Jones, Day, Reavis & Pogue

[57] ABSTRACT

Hinged entry athletic footwear comprising a sole member and a heel member and further comprising a forward foot casing that is secured to and above the sole member to create a foot receiving cavity. The hinged footwear also includes an anterior support casing and a posterior support casing wherein the anterior support casing and the posterior support casing are generally complementary frustoconicals that rise above the heel member. A fastener is provided on the footwear for jointly fastening the anterior support casing and the posterior support casing to the forward foot casing so the anterior support casing and posterior support casing pivot forward and rearward about the fastener. Additionally, the footwear secures the anterior and posterior support casings to a wearer's ankle and lower leg.

13 Claims, 1 Drawing Sheet

ATHLETIC FOOTWEAR WITH HINGED ENTRY AND FASTENING SYSTEM

BACKGROUND OF THE INVENTION

1. Field of the Invention

The present invention relates to footwear, primarily athletic footwear having a hinged entry system that also fastens the footwear to a wearer's foot.

2. Description of the Related Art

For even the casual athlete sports, such as basketball, baseball, and football have progressed beyond the school yard playground to sophisticated athletic arenas. The progression experienced by these and other sports has resulted in increased competition for both the amateur and the professional athlete. Coaches, fans, and the players themselves now ask more of the human body than ever before imagined. As a result of these added bodily stresses, there has arisen a need for protective and supportive athletic equipment. Indeed, one focus for such equipment has occurred in the footwear used by the athlete. More cushion, more support and ease of entry are all demanded by the athlete so as to increase performance and decrease chance of injury.

Despite numerous advances in the cushion provided by athletic footwear, for instance, shoe manufacturers have placed foam, air, and gel in the heels of shoes to provide maximum shock absorption, little has occurred to replace the conventional laced shoe for firmly securing the shoe to the foot. Although Velcro® straps and air pumps have found their way onto and into athletic footwear, there still exists the need to simplify the entry of the user's foot into the shoe while maintaining a firm and supportive fit, as is found, for example, in the ski boot art. Athletic footwear having a higher top or "boot top" tend to accentuate the difficult entry and removal by including numerous laces that require tightening and loosening upon foot entry and removal. Moreover, while footwear designers and manufacturers continue to introduce a plethora of complex containment mechanisms, for example, Reebok® offers a shoe wherein the wearer introduces compressed carbon dioxide into three separate chambers within the shoe to tighten the shoe to the wearer's foot, simple and efficient tightening methods incorporated with ankle and foot support appear overlooked. Other examples of different shoe entry methods are described in U.S. Pat. No. 4,972,613 (issued Nov. 27, 1990 to Christopher J. Loveder) and U.S. Pat. No. 5,184,410 (issued Feb. 9, 1993 to Paul R. Hamilton).

The shoe described in U.S. Pat. No. 4,972,613 includes a frontal subassembly and rear subassembly that reside above the sole of the shoe. The frontal subassembly is comprised of several parts including a toe box, a throat, lace receiving openings on either side of the throat, a tongue, and a pair of partial quarters. The rear subassembly has an inner portion and an outer portion, with the outer portion comprising a U-support that is pivotally attached to the sides of the shoe and pivotally movable between upper and lower positions; a binding strap is used to retain the U-support in its upper position. The shoe described in U.S. Pat. No. 4,972,613 requires laces to fit the shoe to the frontal portion of the user's foot, which laces hinder the user when he or she dons or removes the shoe. Additionally, only the U-support of the rear subassembly pivots; the frontal subassembly remains fixed. Moreover, the multiple parts increase the manufacturing costs by adding to the complexity of manufacture and weaken the overall support provided by the shoe as compared to a shoe of substantially unitary construction.

The pivoting shoe described in U.S. Pat. No. 5,184,410 has forward and rearward portions wherein the forward and rearward portions pivot about a pivot hinge mounted coextensively between an intersection of the shoe heel and the shoe sole. A ranged latch with a locking plunger is used to connect the forward and rearward portions of the shoe during use. The forward portion of the shoe also includes cavities adapted to receive deodorant packages. The pivot hinge located at the intersection of the sole and heel of the shoe fails to add the support required of an athletic shoe and decreases the stability of the shoe by eliminating a sole and heel of primarily unitary construction.

Indeed, in many sports, such as basketball and football, it is important to provide the athlete with maximal ankle support. The athlete may, for example, experience direct physical contact from opposing players thereby introducing external lateral and radial forces to the foot and ankle; in many instances these forces exceed the structural limitations of the human body. Thus, there exists a need for enhancing the strength of the ankle and foot through the use of external devices such as a supportive shoe. While some such shoes do exist, they are often difficult to wear and do not provide the user with flexibility in addition to support.

In view of these factors, there arises a growing demand for athletic footwear that is both easy to wear, that is, the footwear does not demand continuous lacing and unlacing, is easy for the user to slip his or her foot into and out of, and provides support to the foot and ankle without losing flexibility of movement. These needs arise in a variety of shoe categories. For instance, in cleated shoes worn by football players, the field of play is often composed of grass and requires cleats for maximal traction, while the contact experienced during play requires sufficient ankle support. Indeed, mountain shoes worn by all-terrain hikers and street walking shoes employed by the casual athlete still must provide the wearer with adequate support without adding weight and unnecessary complexity.

As such it may be appreciated that there continues to exist a need for new and improved athletic footwear that provides the wearer with maximal support through a hinged entry and fastening system. Such a system eliminates the time required to lace and unlace conventional shoes and, as set forth by the instant invention, addresses both the problems of ease of use and support as well as an efficient design for reduced manufacture costs.

SUMMARY OF THE INVENTION

Hinged entry athletic footwear comprising a sole member and a heel member, wherein the heel member is posterior to the sole member and is fixedly secured to the sole member. The athletic footwear further comprises a forward foot casing that is secured to and above the sole member, thereby creating a cavity for receiving the toes and the anterior portion of a wearer's foot. The hinged footwear also includes an anterior support casing and a posterior support casing wherein the anterior support casing and the posterior support casing are generally complementary frustoconicals that rise above the heel member. Means is provided on the footwear for jointly fastening the anterior support casing and the posterior support casing to the forward foot casing so the anterior support casing and posterior support casing pivot forward and rearward about the fastening means. The fastening means includes hinges attached to a posterior portion of the forward foot casing and on opposing sides of the footwear. Moreover, the hinges are situated above the heel member at the overlap of the anterior support casing and the posterior support casing. Additionally, the footwear includes means for securing the anterior and posterior support casings about a wearer's ankle and lower leg.

The anterior support casing of the hinged athletic footwear includes a lower leading edge. Embedded within the lower leading edge is a forward rigid member that transverses the circumference of the anterior support casing and thus provides increased rigidity to the lower leading edge of the anterior support casing. Likewise, the posterior support casing includes a lower trailing edge that has embedded therein a rear rigid member that transverses the circumference of the posterior support casing and thus provides increased rigidity to the lower leading edge of the posterior support casing.

The forward foot casing of the hinged entry athletic footwear terminates at its posterior edge with a depressed ridge that is adapted for slidably receiving the lower leading edge of the anterior support casing. The depressed ridge also includes a curb that stops the slidable movement of the lower leading edge of the anterior support casing along the depressed ridge. The heel member of the footwear also includes an integrally formed depression adapted for slidably receiving the lower trailing edge of the posterior support casing.

The securing means of the hinged entry athletic footwear comprises at least one strap that is coupled to the anterior support casing and at least one grommet adapted for receiving the strap. The grommet is coupled on a side of the anterior support casing opposite from the support strap. Additionally, means for securing the strap in a single position once the grommet has received the strap is provided.

BRIEF DESCRIPTION OF THE DRAWINGS

The invention may best be understood by reference to the following detailed description when read in conjunction with the accompanying drawings, wherein.

DETAILED DESCRIPTION OF THE PREFERRED EMBODIMENT

Figure 1:
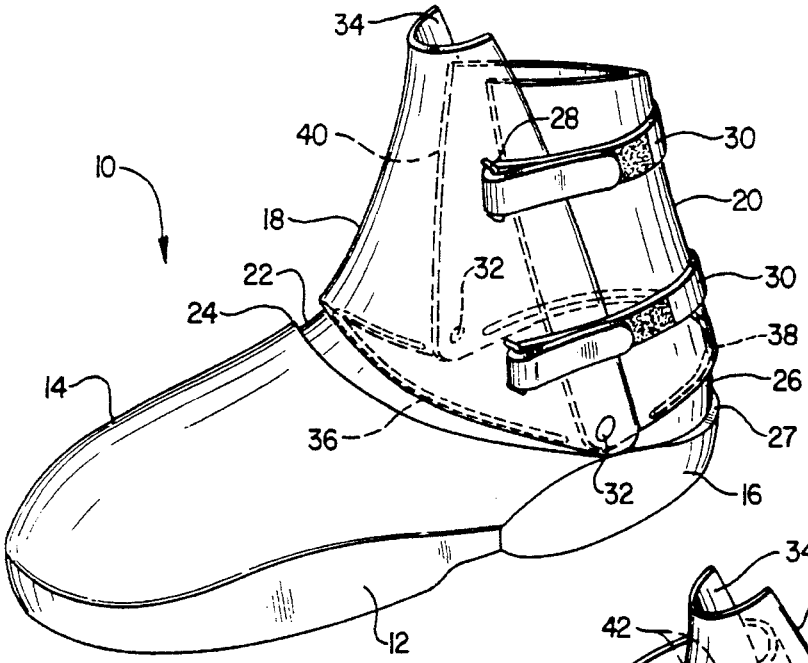
FIG. 1 is a perspective view of the preferred embodiment of the invention illustrating the footwear in a closed state as if engaged about a wearer's foot and lower leg.

Referring now to FIG. 1, there is shown a perspective view of the hinged athletic footwear 10. The footwear 10 is built upon the shoe sole 12 and the shoe heel 16. As is well known in the art, the shoe sole 12 and shoe heel 16 may be comprised of various materials including cushioning foam, gel or compressed air chambers. Additionally, the shoe sole 12 may be configured in a variety of patterns to provide maximal traction depending upon the surface upon which the footwear 10 will be used. For instance, the shoe sole 12 may be adapted to accept cleats when the wearer desires to compete on a grassy surface.

Forward foot casing 14 resides above the shoe sole 12 and is adapted to receive the toes and forward portion of the wearer's foot. At the rear of forward foot casing 14 is anterior support casing 18, and behind anterior support casing 18 is posterior support casing 20. Anterior support casing 18 and posterior support casing 20 are slidably engaged about rivet hinge 32. When in a closed state, as shown in FIG. 1, anterior support casing 18 and posterior support casing 20 create a circular cavity adapted to receive and support the lower leg and ankle of the wearer. In the preferred embodiment, forward foot casing 14, anterior support casing 18, and posterior support casing 20 are manufactured from pliably rigid material such as reinforced leather. This material provides the wearer with sufficient support and protection, while also permitting the wearer to negotiate the awkward positions often achieved on the field of play. It should be apparent to those skilled in the art that an abundance of other materials found on athletic shoes, such as canvas, Lycra, neoprene and spandex may be used as well without detracting from the objectives of the invention.

Rivet hinge 32 permits the slidable engagement of anterior support casing 18 and posterior support casing 20. Anterior support casing 18 may be moved forward toward the toes, while posterior support casing 20 moves backward toward the heel of the foot. Anterior support casing 18 moves along anterior casing guide 22 which is integral with forward foot casing 14. Anterior casing guide 22 is manufactured from a material more rigid than the material used for the forward foot casing 14 and anterior support casing 18. The increased rigidity provides added support for the upper foot, while also permitting anterior support casing 18 to slide over anterior casing guide 22. The slidable engagement between anterior support casing 18 and anterior casing guide 22 is enhanced through anterior rigid member 36 embedded along the lower edge of anterior support casing 18. Anterior rigid member 36 is shown by phantom lines along the lower edge of anterior support casing 18. Anterior casing guide curb 24 limits the movement of anterior support casing 18 along anterior casing guide 22.

Still referring to FIG. 1, posterior support casing 20 moves over posterior casing guide 26. Posterior casing guide 26 is integrally formed with shoe heel 16 and terminates with posterior casing guide curb 27. Posterior rigid member 38 is embedded within the lower edge of posterior support casing 20 and provides enhanced rigidity for the moving edge of posterior support casing 20.

Dual support straps 30 wrap around posterior support casing 20 and loop through grommets 28. In the preferred embodiment, straps affixed with hook and loop material are used to firmly secure support straps 30 about posterior support casing 20 and to bind anterior support casing 18 and posterior support casing 20 in a closed position. Not shown in FIG. 1 is cushioning material that encases the cavity formed by anterior support casing 18 and posterior support casing 20. The cushioning material permits the wearer to tightly secure the anterior support casing 18 and posterior support casing about his or her lower leg and foot without experiencing discomfort.

Figure 2:
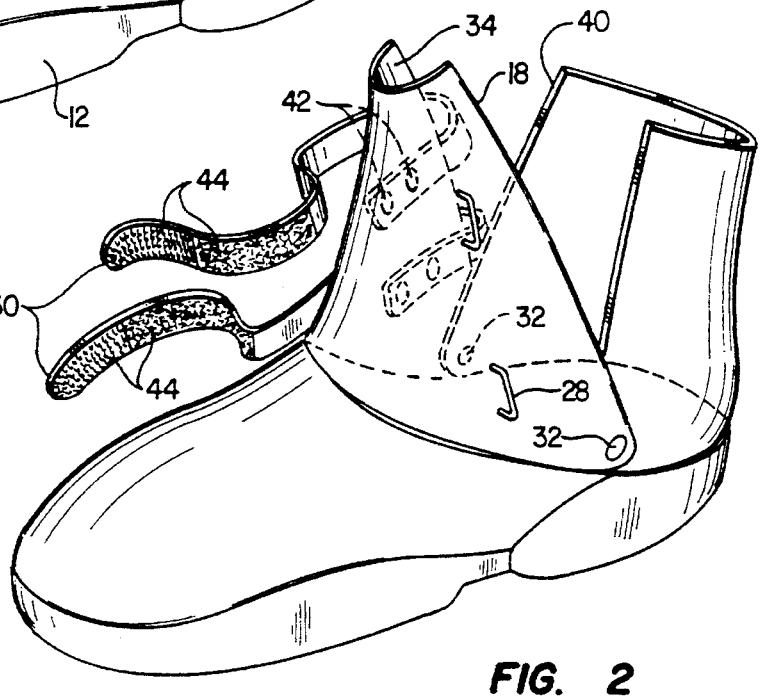
FIG. 2 is a perspective view of the preferred embodiment of the invention illustrating the footwear in an open state as if the wearer were removing or inserting his or her foot.

Referring now to FIG. 2, there is shown a perspective view of the hinged footwear 10 in an open state. FIG. 2 illustrates the attachment of the dual support straps 30 to anterior support casing 18. The attachment of dual support straps 30 to anterior support casing 18 is accomplished, in the preferred embodiment, by strap rivets 42. Two strap rivets 42 are provided for each support strap 30. Using two strap rivets 42 for each support strap 30 ensures the strength of the strap attachment.

FIG. 2 in conjunction with FIG. 1 fully discloses the operation of the hinged entry system incorporated within the present invention. In a closed state, as shown in FIG. 1, anterior support inner wall 34 engages posterior casing edge 40. In the closed state, it is apparent that the side walls created by the overlap of anterior support casing 18 and posterior support casing 20 provides for the wearer with added support against lateral and radial forces inflicted during the exercise being performed.

When the wearer desires to either don or remove hinged footwear 10, he or she pulls anterior support casing 18 away from posterior support casing 20. Both anterior support casing 18 and posterior support casing 20 will rotate about the axis created by rivet hinge 32. As the wearer pulls anterior support casing 18 from posterior support casing 20, posterior casing edge 40 will slide over anterior support casing inner wall 34. Additionally, anterior support casing 18 will slide over anterior casing guide 22 until halted by anterior casing guide curb 24. Likewise, posterior support casing 20 will slide over posterior casing guide 26 until halted by posterior casing guide curb 27. At this point hinged footwear 10 is in its maximal open position. The wearer may now insert his or her foot into the footwear. Once the wearer has his or her foot completely within the footwear 10, anterior support casing 18 and posterior support casing 20 are pushed together such that the inner walls of each casing rest firmly against the wearer's lower leg and ankle. At this point dual support straps 30 are wrapped around posterior support casing 20, pulled through the respective grommet 28 and tightened by looping each support strap 30 backward and securing the hook and loop material liner 44. When the wearer desires to remove the footwear 10, support straps 30 are pulled apart and casings 18 and 20 pulled forward and rearward to open the footwear.

Figure 3:
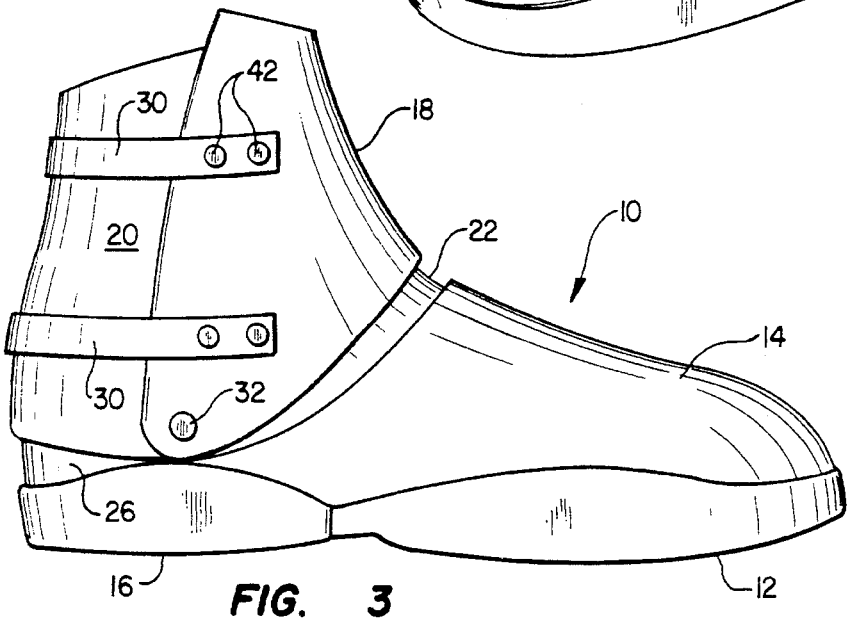
FIG. 3 is a side view of the athletic footwear with hinged entry and fastening system showing the footwear in a closed state and the locking straps maintaining the closed state.

Referring now to FIG. 3, there is illustrated a side view of the hinged footwear 10 in a closed state. FIG. 3 reveals the simplicity of the invention's design. The invention as described herein employs only three major components to achieve the desired results. Excluding shoe sole 12 and shoe heel 16, which are necessary components of any footwear, the major components comprise forward foot casing 14, anterior support casing 18, and posterior support casing 20. The simple design of the footwear eases the burden placed upon the manufacturer and enables the footwear to be produced at a lower cost.

The only significant additions beyond the three named major components include rivet hinges 32 and dual support straps 30. Rivet hinges 32, in addition to permitting the pivoted opening of the footwear, also securely joins forward casing 14, anterior support casing 18, and posterior support casing 20 together. Although support straps comprised of hook and loop material are disclosed in this embodiment those skilled in the art will appreciate the variances available. For instance, dual ratcheted straps may be used in place of dual straps comprised of hook and loop material as shown in the preferred embodiment. Moreover, it is further demonstrated by FIG. 3 that the hinged entry footwear does not require laces to conform to the wearer's foot. The dual support straps 30 pull the anterior support casing around the wearer's foot, thereby providing the necessary fit of an athletic shoe.

While the invention has been described in detail herein with reference to its preferred embodiment, it is to be understood that this description is by way of example only, and is not to be construed in a limiting sense. It is to be further understood that numerous changes in details of the embodiment of the invention and additional embodiments of the invention, will be apparent to, and may be made by, persons of ordinary skill in the art having reference to this specification. It is contemplated that such changes and additional embodiments are within the scope and true scope of the invention as claimed below.

I claim:

1. A pivot-entry shoe comprising:

a flexible base member including a forward portion and a heel portion for providing flexibility of movement to a wearer's foot;

a flexible forward encasement attached to and above said forward portion of said flexible base member;

a pair of flexible complementary generally frustoconical members for providing support to a wearer's ankle and lower leg;

means for pivotally securing said pair of complementary generally frustoconical members to said forward encasement;

wherein each of said frustoconical members includes a lower edge wherein a rigid member is embedded in each lower edge for providing increased rigidity to said lower edges; and means for securing said frustoconical members to a wearer's ankle and lower leg.

2. The pivot-entry shoe in claim 1 wherein said forward encasement has a generally inverted U-shape and extends over said base member and terminates at an anterior section of said heel portion of said base member.

3. The pivot-entry shoe in claim 2 wherein said pair of complementary generally frustoconical members overlap at the termination of said forward encasement.

4. The pivot-entry shoe in claim 3 wherein said pivotal securing means is situated at said overlap of said pair of complementary generally frustoconical members, said pivotal securing means comprising a pin placed at opposing overlap points.

5. A system for supporting the lower leg, ankle, and foot of a user while providing simple access to said system through a pivot entry element, said system comprising:

a flexible unitary sole member including a posterior heel portion for providing flexibility of movement to a wearer's foot;

a flexible forward foot container including said flexible sole member as a base and a generally pliable material secured to and above said sole member;

a flexible generally vertical tubular portion defining an upper aperture and a lower aperture, said tubular portion defining said lower aperture connected to and encircling said posterior heel portion of said flexible unitary sole member for providing support to a wearer's ankle and lower leg;

said generally tubular portion including at least two complementary casings wherein said complementary casings are movably connected to said forward foot container about a pivot point above said posterior heel portion of said unitary sole member such that said two complementary casings move about said pivot so as to expand said upper aperture of said generally tubular portion or to restrict said upper aperture of said generally tubular portion such that a user may insert a foot into said system and secure said system to said foot;

wherein each of said casings includes a lower edge wherein a rigid member is embedded in each lower edge for providing increased rigidity to said lower edges; and means for securing said system to a user.

6. The system in claim 5 wherein said securing means includes at least one fastening member that binds said complementary casings together thereby restricting movement of said casings about said pivot point and firmly securing said system to a user.

7. Hinged entry athletic footwear for use in athletic sport activities comprising:

a flexible sole member for providing flexibility of movement to a wearer's foot;

a heel member, wherein said heel member is posterior to said sole member and fixedly secured to said sole member;

a forward foot casing formed of a pliable material, wherein said foot casing includes a front and back edge and is secured to and above said sole member and thereby creates a cavity for receiving the toes and the anterior portion of a wearer's foot;

a flexible anterior support casing including a lower leading edge wherein a forward rigid member is embedded within said lower leading edge of said anterior support casing and transverses the circumference of said anterior support casing thereby providing increased rigidity to said lower leading edge of said anterior support casing;

a flexible posterior support casing;

said anterior support casing and said posterior support casing each being generally complementary frustoconical shaped casings rising above said heel member for providing support to a wearer's ankle and lower leg;

means for jointly fastening said anterior support casing and said posterior support casing to said forward foot casing such that said anterior support casing and said posterior support casing pivot forward and rearward about said fastening means; and means for securing said anterior and posterior support casings to a wearer's ankle and lower leg.

8. The hinged entry athletic footwear in claim 7 wherein said forward foot casing includes a depressed ridge, said depressed ridge being located at said back edge of said forward foot casing and said depressed ridge being adapted for slidably receiving said lower leading edge of said anterior support casing.

9. The hinged entry athletic footwear in claim 3 wherein said depressed ridge includes a curb to stop the slidable movement of said lower leading edge of said anterior support casing along said depressed ridge.

10. The hinged entry athletic footwear in claim 7 wherein said posterior support casing includes a lower trailing edge wherein a rear rigid member is embedded within said lower trailing edge of said posterior support casing and transverses the circumference of said posterior support casing thereby providing increased rigidity to said lower leading edge of said posterior support casing.

11. The hinged entry athletic footwear in claim 10 wherein said heel member includes an integrally formed depression adapted for slidably receiving said lower trailing edge of said posterior support casing.

12. The hinged entry athletic footwear in claim 7 wherein said fastening means includes hinges attached to said back edge of said forward foot casing on opposing sides of said footwear wherein said anterior and posterior support casings overlap at said hinges.

13. The hinged entry athletic footwear in claim 7 wherein said securing means comprises:

at least one strap coupled to said anterior support casing;

at least one grommet adapted for receiving said strap, wherein said grommet is coupled to an opposite side of said anterior support casing from said strap; and means for securing said strap in a single position once said grommet has received said strap.

* * * * *